US009939184B2

(12) United States Patent
Yura et al.

(10) Patent No.: US 9,939,184 B2
(45) Date of Patent: Apr. 10, 2018

(54) REFRIGERATION DEVICE

(71) Applicant: DAIKIN INDUSTRIES, LTD., Osaka-shi, Osaka (JP)

(72) Inventors: Yoshinori Yura, Sakai (JP); Shinichi Kasahara, Sakai (JP); Kousuke Kibo, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 629 days.

(21) Appl. No.: 14/347,807

(22) PCT Filed: Sep. 28, 2012

(86) PCT No.: PCT/JP2012/075095

§ 371 (c)(1),
(2) Date: Mar. 27, 2014

(87) PCT Pub. No.: WO2013/047754

PCT Pub. Date: Apr. 4, 2013

(65) Prior Publication Data

US 2014/0230476 A1 Aug. 21, 2014

(30) Foreign Application Priority Data

Sep. 30, 2011 (JP) ..... 2011-218390
Sep. 27, 2012 (JP) ..... 2012-213551

(51) Int. Cl.
*F25B 1/00* (2006.01)
*F25B 45/00* (2006.01)
(Continued)

(52) U.S. Cl.
CPC ..... *F25B 49/02* (2013.01); *F25B 31/002* (2013.01); *F25B 2400/01* (2013.01);
(Continued)

(58) Field of Classification Search
CPC ..... F25B 2400/01; F25B 2500/26; F25B 2700/193; F25B 2700/2105; F25B 2700/21155; F25B 31/002
(Continued)

(56) References Cited

U.S. PATENT DOCUMENTS 3,705,499 A 12/1972 Mount et al.
4,624,112 A * 11/1986 Proctor ..... B60H 1/00585 62/149
(Continued)

FOREIGN PATENT DOCUMENTS

JP 6-18076 A 1/1994
JP 9-170826 A 6/1997
(Continued)

OTHER PUBLICATIONS

European Search Report of corresponding EP Application No. 12 83 5998.1 dated Aug. 14, 2015.
(Continued)

*Primary Examiner* — Henry Crenshaw

(57) ABSTRACT

A refrigeration device includes a radiator, an evaporator, a compressor, a heater and a control device. The radiator causes a refrigerant to radiate heat. The evaporator causes the refrigerant to evaporate. The compressor compresses the refrigerant circulating between the radiator and the evaporator. The heater heats lubricating oil in the compressor. The control device controls the heater so that an oil temperature of the lubricating oil in the compressor reaches an oil temperature target value obtained by adding a predetermined temperature to saturation temperature of the refrigerant in the compressor.

13 Claims, 10 Drawing Sheets

(51) Int. Cl.
*F25B 49/00* (2006.01)
*F25B 49/02* (2006.01)
*F25B 31/00* (2006.01)

(52) U.S. Cl.
CPC ..... *F25B 2500/26* (2013.01); *F25B 2500/31* (2013.01); *F25B 2700/193* (2013.01); *F25B 2700/1933* (2013.01); *F25B 2700/2105* (2013.01); *F25B 2700/21155* (2013.01)

(58) Field of Classification Search
USPC ..... 62/229, 228.5, 115, 149, 498
See application file for complete search history.

(56) References Cited

U.S. PATENT DOCUMENTS 5,318,151 A * 6/1994 Hood ..... F04C 29/021 184/104.1
5,577,390 A * 11/1996 Kaido ..... F04B 25/005 236/1 EA
6,041,608 A * 3/2000 Fujiwara ..... F25B 9/00 62/229
2003/0077179 A1* 4/2003 Collins ..... F04B 49/065 417/63
2005/0175492 A1* 8/2005 Hirooka ..... F04B 15/08 417/440
2007/0142168 A1* 6/2007 DeMarco ..... B60W 30/194 477/41
2007/0219650 A1* 9/2007 Wang ..... G01F 1/6847 700/73
2008/0027568 A1* 1/2008 Pearson ..... G05B 23/0227 700/80
2010/0162742 A1 7/2010 Shimoda et al.
2011/0016916 A1* 1/2011 Tsukamoto ..... F04D 29/063 62/498
2011/0113797 A1* 5/2011 Peyaud ..... F25B 49/02 62/115

FOREIGN PATENT DOCUMENTS

JP 10-148405 A 6/1998
JP 2001-73952 A 3/2001
JP 2005-351590 A 12/2005
JP 4111246 B2 7/2008
JP 2009-85463 A 4/2009

OTHER PUBLICATIONS

International Preliminary Report of corresponding PCT Application No. PCT/JP2012/075095.
International Search Report of corresponding PCT Application No. PCT/JP2012/075095.

* cited by examiner

REFRIGERATION DEVICE

CROSS-REFERENCE TO RELATED APPLICATIONS

This U.S. National stage application claims priority under 35 U.S.C. § 119(a) to Japanese Patent Application Nos. 2011-218390, filed in Japan on Sep. 30, 2011, and 2012-213551, filed Sep. 27, 2012, the entire contents of which are hereby incorporated herein by reference.

TECHNICAL FIELD

The present invention relates to a refrigeration device in which a refrigerant is compressed by a compressor.

BACKGROUND ART

Conventionally, as air-conditioning devices for transferring heat between indoors and outdoors, there have been air-conditioning devices comprising a usage-side heat exchanger disposed indoors and a heat-source-side heat exchanger disposed outdoors. In an air-conditioning device of such description, in order to transfer heat, one of the usage-side heat exchanger and the heat-source-side heat exchanger is used as a radiator, and the other is used as an evaporator. For example, in air-conditioning devices of such description, a refrigerant is circulated between the usage-side heat exchanger and the heat-source-side heat exchanger and heat is transferred; therefore, a refrigeration device is generally configured using a compressor for compressing the refrigerant, and the usage-side heat exchanger and the heat-source-side heat exchanger (radiator and evaporator).

In a refrigeration device of this type, if the lubricating oil temperature (hereafter referred to as "oil temperature") is low when the pressure in the crank case is under a fixed condition when the compressor is stopped, the proportion of the refrigerant dissolving into the lubricating oil in the crank case increases. Under additional conditions such as a long-term shutdown of the compressor and/or a change in the temperature of the refrigerant or temperature of external air, the phenomenon that we call "refrigerant stagnation" occurs, and a large amount of the refrigerant solves into the lubricating oil in the compressor under the refrigerant stagnation. When the refrigerant stagnates into the lubricating oil, e.g., the viscosity of the lubricating oil decreases and the performance of the lubricating oil decreases.

Accordingly, in order to prevent refrigerant stagnation in the compressor, measures have conventionally been taken to mount a heater to the crank case and warm the compressor and prevent the refrigerant from stagnating even when the compressor is stopped. There are also instances in which the lubricating oil in the compressor is warmed by motor coil heating using open-phase energization.

However, energizing the heater to warm the compressor presents a problem in that a given amount of power (standby power) is consumed, increasing the amount of power consumed by the refrigeration device.

SUMMARY

Technical Problem

In order to cut the standby power consumed by the compressor, e.g., each of Patent Literature 1 (JP-A 2001-73952) or Patent Literature 2 (Japanese Patent No. 4111246) discloses a technique for determining, on the basis of the refrigerant temperature or the external air temperature, periods in which heating by the compressor heater is not necessary, controlling the heater, and cutting the standby power.

In the techniques in JP-A 2001-73952 and Japanese Patent No. 4111246, although it is possible to cut the standby power, there remains scope for further cutting the standby power. In addition, since control is not performed on the basis of the amount of the refrigerant solved into the lubricating oil in the compressor, there may be instances in which heating by the heater is insufficient.

Meanwhile, according to prior art disclosed in JP-A 9-170826, the compressor heater is controlled on the basis of the concentration of oil in the mixture of the lubricating oil and the refrigerant (i.e., proportion of lubricating oil in the mixture). However, the heater control disclosed in JP-A 9-170826 involves a complex calculation for obtaining the current oil concentration from curves indicating the solubility characteristics of the refrigerant and the lubricating oil, and is not practical. For example, in the technique in JP-A 9-170826, the curve indicating the solubility characteristics has to be obtained every time there is a change in the refrigerant and/or lubricating oil type and/or combination and/or a condition. Therefore, not only will there be an increase in cost required to acquire data from which the solubility curve is obtained and/or the amount of work required to obtain a regression formula created from the data, but there will also be an increase in calculation load, such as an increase in the amount of data processed by a microcomputer during actuation.

An object of the present invention is to provide, at a low cost, a refrigeration device in which an appropriate oil concentration or oil viscosity can be readily maintained with regards to lubricating oil in a compressor and in which a cut in standby power can be achieved.

Solution to Problem

A refrigeration device according to a first aspect of the present invention comprises a radiator for causing a refrigerant to radiate heat, an evaporator for causing the refrigerant to evaporate, a compressor for compressing the refrigerant circulating between the radiator and the evaporator, a heater for heating lubricating oil in the compressor and a control device for controlling the heater. The control device controls the heater so that the oil temperature of the lubricating oil in the compressor reaches an oil temperature target value obtained by adding a predetermined temperature to the saturation temperature of the refrigerant in the compressor.

According to the refrigeration device of the first aspect, controlling the heater using the oil temperature target value for the lubricating oil and the current oil temperature makes it possible to control the heater in a simple manner using temperature as a parameter. Since the predetermined temperature is added to the saturation temperature of the refrigerant, it is possible to minimize the refrigerant from dissolving into the lubricating oil when the temperature of the external air or the like does not reach the saturation temperature of the refrigerant, and readily maintain the oil concentration and/or oil viscosity. In addition, since the heater can be switched ON/OFF on the basis of the saturation temperature of the refrigerant, the heater can be switched OFF when heating is unnecessary without being affected by external air conditions or the like, and a cut in standby power can be achieved.

A refrigeration device according to a second aspect of the present invention is the refrigerant device according to the first aspect, and further comprises a refrigerant pressure detector for detecting the pressure of the refrigerant in the compressor. The oil temperature target value is set, using the predetermined temperature, to a temperature of a mixture of the lubricating oil and the refrigerant at which the oil concentration or the oil viscosity at solubility equilibrium at the pressure of the refrigerant is within a predetermined set range.

According to the refrigeration device of the second aspect, the oil temperature target value is set, using the predetermined temperature to a temperature of the mixture at which the oil concentration and/or the oil viscosity at the pressure of the refrigerant is within a predetermined set range, whereby the heater is controlled in a manner that enables the standby power to be cut while preventing a state in which heating by the heater is insufficient.

A refrigeration device according to a third aspect of the present invention is the refrigeration device according to the second aspect, wherein the oil temperature target value is set, using the predetermined temperature, to the temperature of the mixture of the lubricating oil and the refrigerant at which the oil concentration or the oil viscosity at solubility equilibrium at the pressure of the refrigerant is at a predetermined set value.

According to the refrigeration device of the third aspect, the heater can be controlled so as to result in an oil temperature at which an oil concentration or oil viscosity is maintained a fixed condition.

A refrigeration device according to a fourth aspect of the present invention is the refrigeration device according to any of the first through third aspects, wherein the control device holds the predetermined temperature as data for each of the saturation temperatures.

According to the refrigeration device of the fourth aspect, it is possible to use the data to omit the workload for, e.g., the calculation performed by the control device.

A refrigeration device according to a fifth aspect of the present invention is the refrigerant device according to any of the first through fourth aspect, and further comprises a temperature detector for measuring the oil temperature of the lubricating oil in the compressor and outputting the oil temperature to the control device or measurement devices for performing a measurement relating to a parameter for estimating the oil temperature of the lubricating oil in the compressor and outputting the result of the measurement to the control device.

According to the refrigeration device of the fifth aspect, providing the dedicated temperature detector or the measuring device for measuring the oil temperature of the lubricating oil in the compressor makes it possible to detect the oil temperature of the lubricating oil in the compressor in a relatively accurate manner.

A refrigeration device according to a sixth aspect of the present invention is the refrigeration device according to a fifth aspect, wherein the control device performs, when the refrigeration device is being launched, a selection between normal start-up and special start-up for refrigerant stagnation on the basis of the oil temperature of the lubricating oil and the oil temperature target value.

According to the refrigeration device of the sixth aspect, it is possible to appropriately make a selection between normal start-up and special start-up, therefore improving the reliability of the compressor.

A refrigeration device according to a seventh aspect of the present invention is the refrigeration device according to the sixth aspect, wherein the special start-up includes a plurality of special start-ups for refrigerant stagnation having different settings from each other. When selecting the special start-up instead of the normal start-up, the control device performs a selection from the special start-ups on the basis of the oil temperature of the lubricating oil and the oil temperature target value.

According to the refrigeration device of the seventh aspect, it is possible to select a more appropriate special start-up on the basis of the oil temperature and the oil temperature target value, and the reliability is improved compared to an instance in which no selection of the special start-up is available.

A refrigeration device according to an eighth aspect of the present invention is the refrigeration device according to the sixth or seventh aspects, wherein at the initial start-up after a power supply fed to the refrigeration device from the exterior is switched ON, the control device selects, according to test operation implementation history, whether to perform a test operation or to perform the special start-up.

According to the refrigeration device of the eighth aspect, the control device can be used to switch between test operation and stagnation operation, making it possible to perform a test operation of the refrigeration device as required at the site of usage and the like.

Effect of the Invention

In the refrigeration device according to the first aspect of the present invention, performing control using the saturation temperature and the predetermined temperature simplifies the control and therefore makes it possible to minimize cost, while also making it possible to maintain an appropriate oil concentration or oil viscosity with regards to the lubricating oil in the compressor and achieve a cut in the standby power.

In the refrigeration device according to the second aspect of the present invention, it is possible to avoid performing a control that results in an unnecessarily high oil concentration or oil viscosity, therefore improving the effect of cutting the standby power.

In the refrigeration device according to the third aspect of the present invention, it is possible to cut the standby power while maintaining a uniform oil concentration or oil viscosity.

In the refrigeration device according to the fourth aspect of the present invention, it is possible for the control device to control the heater at a high speed, and the speed of response of the compressor to a change in situation is increased. From another perspective, it is possible to suppress an increase in the calculation region used in the control.

In the refrigeration device according to the fifth aspect of the present invention, control can be performed accurately on the basis of an accurate lubricating oil temperature.

In the refrigeration device according to the sixth aspect of the present invention, special start-up can be performed in an appropriate manner when special start-up is necessary, and the reliability is improved.

In the refrigeration device according to the seventh aspect of the present invention, it is possible to select the appropriate special start-up and thereby improve reliability.

In the refrigeration device according to the eighth aspect of the present invention, it is possible to switch between test operation and special start-up, and installation of the refrigeration device is made easier. In addition, unnecessary stagnation operation can be avoided.

DESCRIPTION OF EMBODIMENTS

Embodiments of the present invention will now be described with reference to the accompanying drawings. Embodiments of the compressor according to the present invention are not limited to that described below, and can be modified without departing from the scope of the present invention.

First Embodiment

(1) Configuration of Refrigeration Device (1-1) Refrigerant Circuit

Figure 1:
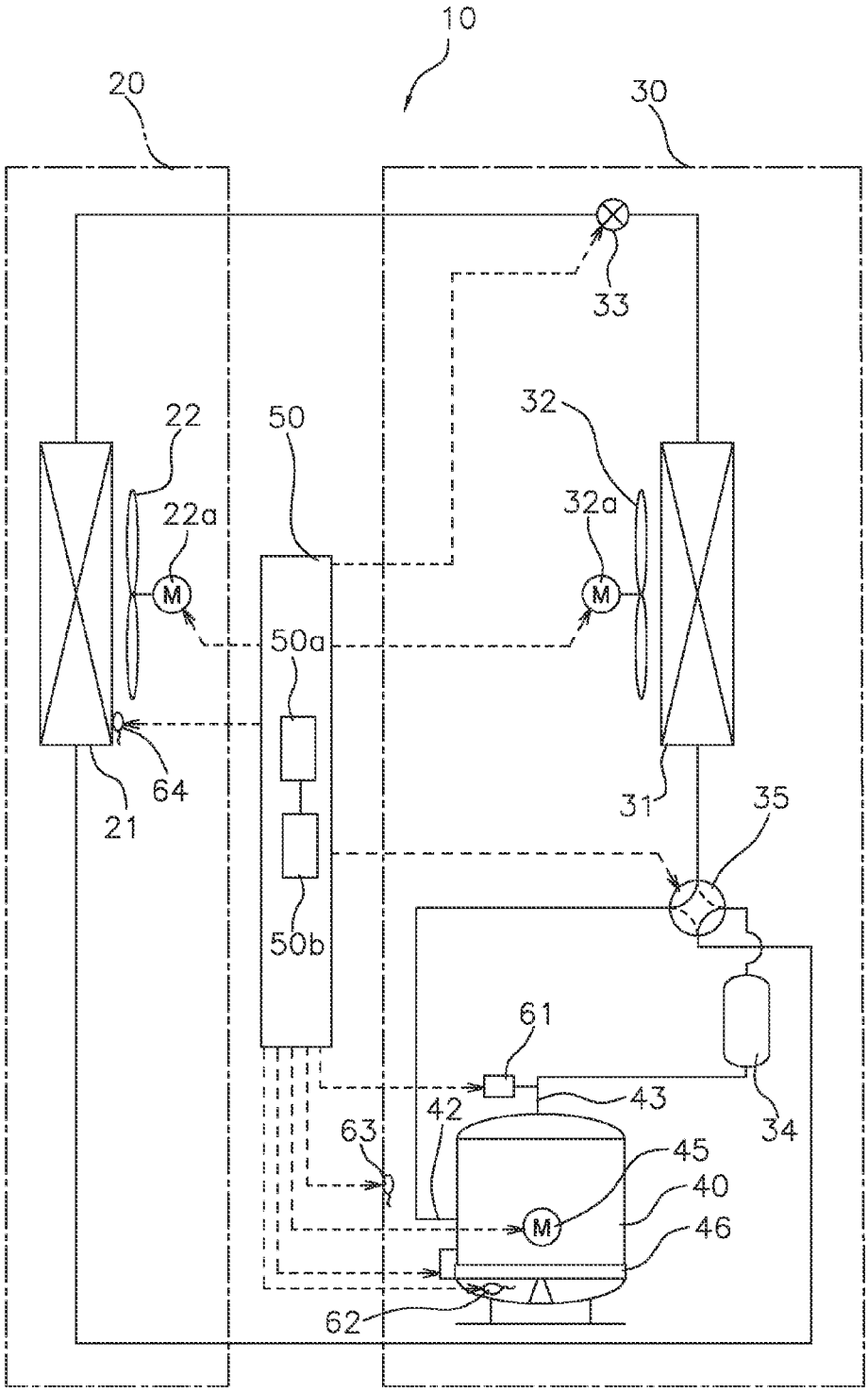
FIG. 1 is a refrigerant circuit diagram illustrating the configuration of an air-conditioning device according to an embodiment of the present invention.

FIG. 1 is a refrigerant circuit diagram showing the configuration of an air-conditioning device 10 in which a refrigeration device according to a first embodiment of the present invention is employed. The air-conditioning device 10 comprises a usage-side unit 20 installed indoors, and a heat-source-side unit 30 installed outdoors. An indoor heat exchanger 21 and an indoor fan 22 are disposed in the usage-side unit 20. An outdoor heat exchanger 31, an outdoor fan 32, an electric valve 33, an accumulator 34, a four-way switching valve 35, and a compressor 40 are disposed in the heat-source-side unit 30.

The air-conditioning device 10 in FIG. 1 comprises the four-way switching valve 35, and the four-way switching valve 35 enables switching between a cooling operation in which the indoor space is cooled and a heating operation in which the indoor space is heated. During a cooling operation, the indoor heat exchanger 21 functions as an evaporator and the outdoor heat exchanger 31 functions as a radiator. During a heating operation, in contrast, the indoor heat exchanger 21 functions as a radiator and the outdoor heat exchanger 31 functions as an evaporator.

The four-way switching valve 35 has four ports, from a first port to a fourth port. In the four-way switching valve 35, the first and second ports are connected and the third and fourth ports are connected during cooling, and the first and third ports are connected and the second and fourth ports are connected during heating. A discharge pipe 42 of the compressor 40 is connected to the first port of the four-way switching valve 35, one end of the outdoor heat exchanger 31 is connected to the second port, one end of the indoor heat exchanger 21 is connected to the third port, and an intake pipe of the accumulator 34 is connected to the fourth port.

The connections between parts of the usage-side unit 20 and the heat-source-side unit 30 other than the four-way switching valve 35 in the air-conditioning device 10 are as follows. Specifically, one end of the electric valve 33 is connected to the other end of the outdoor heat exchanger 31. The other end of the indoor heat exchanger 21 is connected to the other end of the electric valve 33. A discharge pipe of the accumulator 34 is connected to an intake pipe 43 of the compressor 40.

(1-2) Configuration of the Compressor

Figure 2:
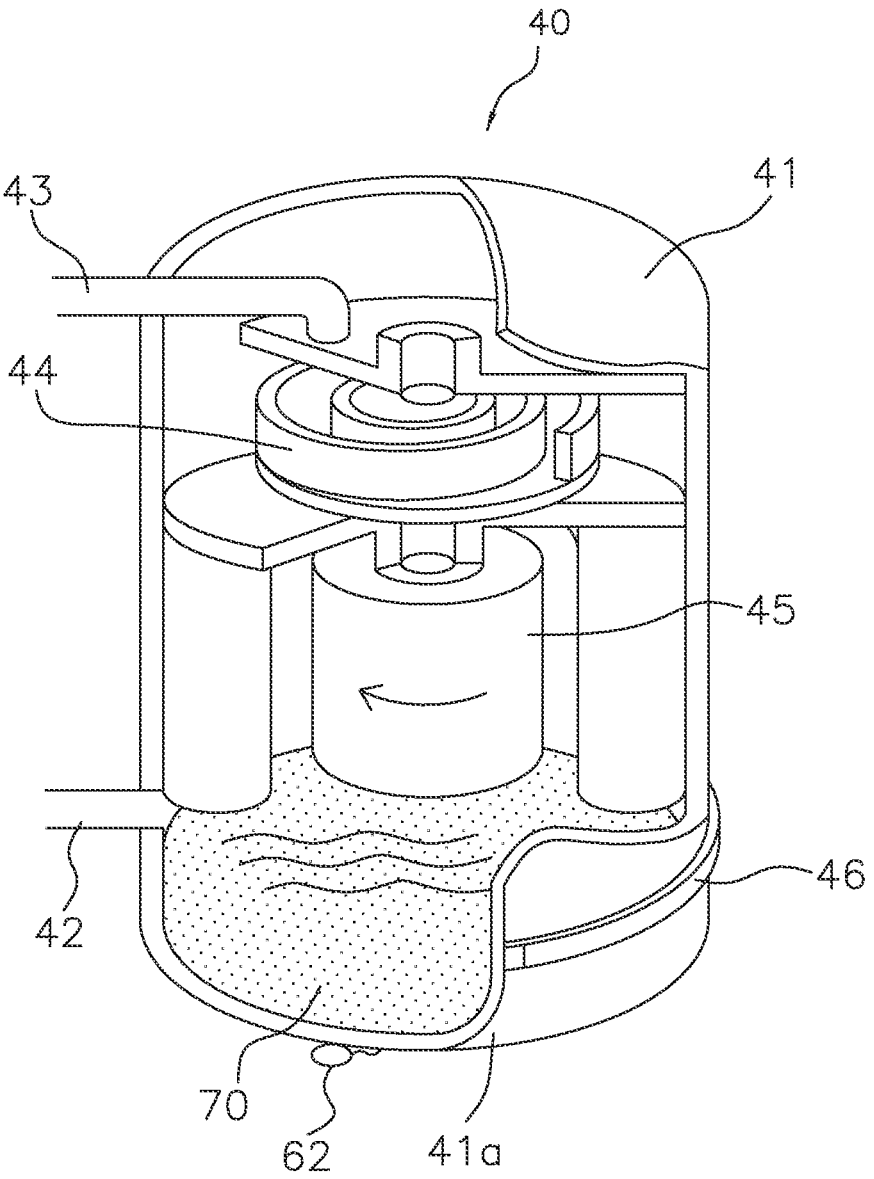
FIG. 2 is a partially cutaway perspective view illustrating the configuration of a compressor.

FIG. 2 is a partially cutaway perspective view of the compressor 40. The discharge pipe 42 is mounted on a side part of a cylindrical casing 41, and an intake pipe 43 is mounted on an upper part. A scroll 44 is provided below the intake pipe 43, and a motor 45 for driving the scroll 44 is provided below the scroll 44. A configuration is present so that lubricating oil 70 accumulates at a bottom part 41*a* of the cylindrical casing 41, and a crank case heater 46 is mounted so as to be wound onto the bottom part 41*a* of the casing 41. An oil temperature detector 62 is mounted on the bottom part 41*a* in which the lubricating oil 70 accumulates.

(1-3) Control Device and Measurement Instruments

As shown in FIG. 1, the air-conditioning device 10 also comprises a control device 50 for controlling the operation of the air-conditioning device 10 and a variety of measurement instruments. Measurement instruments relating to controlling the crank case heater 46 of the compressor 40 are indicated herein; many of the other measurement instruments will not be described. The control device 50 comprises a microcomputer comprising, e.g., a central processing unit (CPU) 50*a*, a memory 50*b*, and the like. The control device 50 is connected to a fan motor 22*a* of the indoor fan 22, a fan motor 32*a* of the outdoor fan 32, the electric valve 33, the four-way switching valve 35, and the motor 45 and the crank case heater 46 of the compressor 40. A refrigerant pressure detector 61 for measuring the pressure in the intake pipe 43 of the compressor 40, an oil temperature detector 62 for detecting the temperature of the lubricating oil 70 in the compressor 40, an external air temperature detector 63 for detecting the external air temperature, and a heat exchange temperature detector 64 for detecting the temperature of the indoor heat exchanger 21, are connected to the control device 50.

(2) Control of Crank Heater

Figure 3:
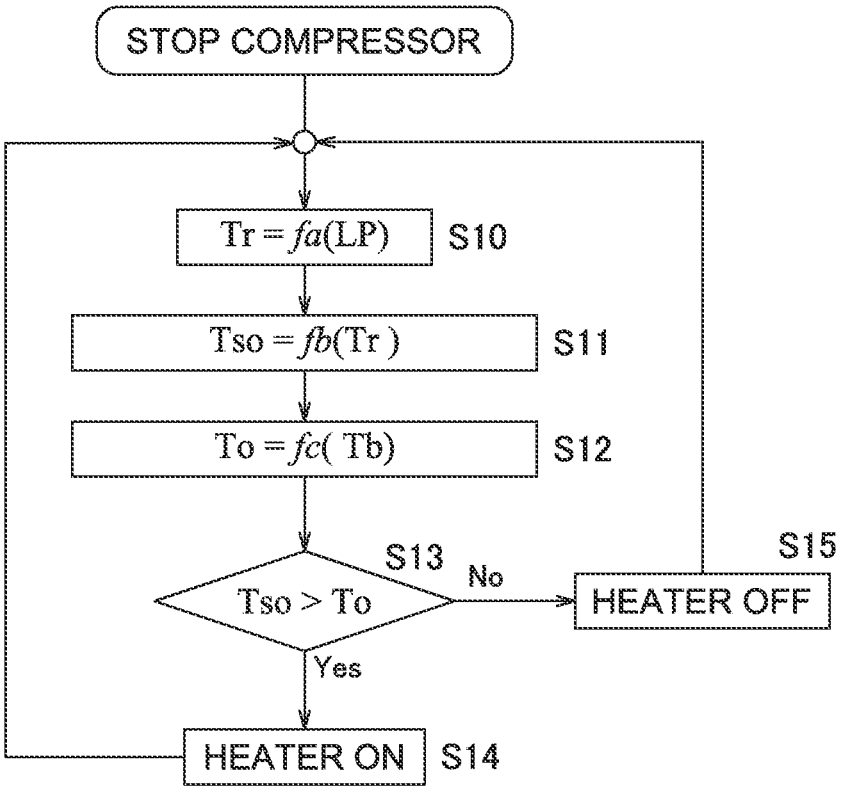
FIG. 3 is a flow chart illustrating heater control by a control device.

A description will now be given with regards to control of the crank case heater 46 performed by the control device 50 along the flow chart shown in FIG. 3. The control device 50 controls the motor 45 of the compressor 40 and therefore has information relating to the states of the compressor 40 during actuation and stoppage.

In a state in which the compressor 40 is stopped, the control device 50 first receives a result of detection by the refrigerant pressure detector 61 and calculates the saturation temperature in the compressor 40 (step S10). As long as the refrigerant pressure LP is known, the saturation temperature $T_r$ of the refrigerant can be easily calculated from the relationship between the refrigerant pressure and the saturation temperature using a conventionally well-known method. For example, the control device 50 stores a formula fa indicating the relationship between the refrigerant pressure LP and the saturation gas temperature (hereafter referred to as the saturation temperature $T_r$), and calculates the saturation temperature $T_r$ using the formula fa.

Next, the control device 50 adds a predetermined temperature (hereafter referred to as an oil temperature offset value) to the saturation temperature $T_r$ obtained in step S10 and calculates an oil temperature target value $T_{so}$. The oil temperature offset value is determined on the basis of data stored in the memory 50*b* of the control device 50 (step S11). A more detailed description of the oil temperature offset value will be given further below.

Figure 4:
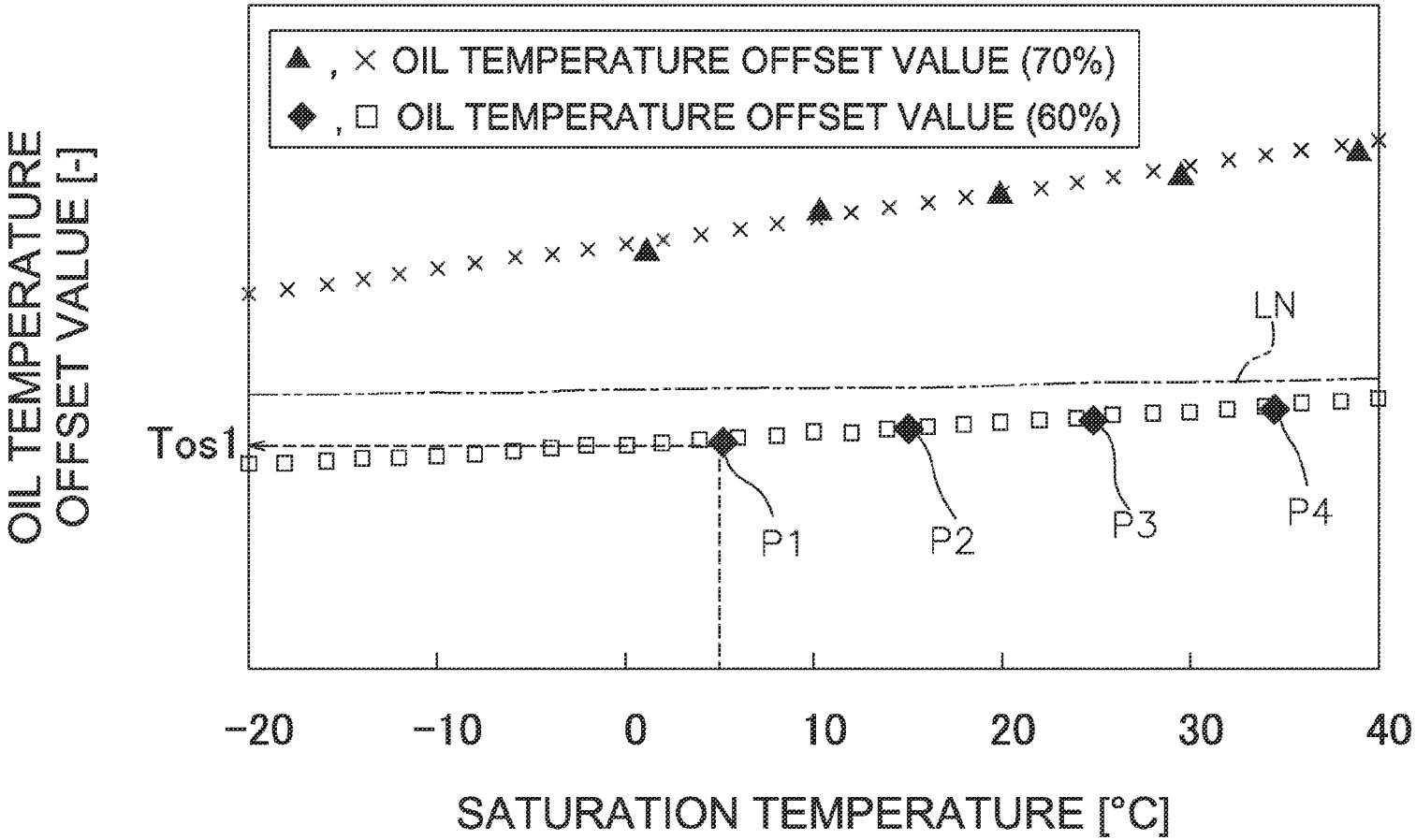
FIG. 4 is a graph showing the relationship between the saturation temperature and the oil temperature offset value.

FIG. 4 is a graph showing the relationship between the saturation temperature Tr and the oil temperature offset value. The graph shown in FIG. 4 varies according to the oil concentration $C_{so}$. FIG. 4 shows two plots representing an instance in which the oil concentration $C_{so}$ is 60% (i.e., the refrigerant concentration is 40%) and an instance in which the oil concentration $C_{so}$ is 70% (i.e., the refrigerant concentration is 30%). For example, if the oil concentration $C_{so}$ of the refrigeration device in the air-conditioning device 10 is set to 60%, the data corresponding to the lower side plots (the concentration $C_{so}$ is 60%) in FIG. 4 is used, and no other data is used. If the saturation temperature $T_r$ obtained in step S10 is 5° C., the oil temperature offset value is determined to be Tos1° C. from point P1. Therefore, the oil temperature target value $T_{so}$ is determined to be 5° C.+Tos1° C. (saturation temperature $T_r$ oil temperature offset value). The graph shown in FIG. 4 is approximated, e.g., by simple quadratic formula fb, and the control device 50 calculates the oil temperature target value $T_{so}$ from the values for the oil concentration $C_{so}$ and the saturation temperature $T_r$. With regards to the formula fb ($T_r$), a formula is made available for each value for the oil concentration $C_{so}$. A formula is selected according to the value for the oil concentration $C_{so}$, and the oil temperature target value $T_{so}$ is calculated from the value for the saturation temperature $T_r$ using the selected formula fb ($T_r$).

The control device 50 detects the oil temperature of the lubricating oil 70 in the compressor 40 using the oil temperature detector 62 (step S12). The oil temperature detector 62 may be installed so as to directly detect the oil temperature of the lubricating oil 70, but is mounted on the bottom part 41*a* of the casing 41 in this instance. The location at which the oil temperature detector 62 is installed may be, e.g., a side part of the compressor 40, as long as the location is in the vicinity of an oil reservoir. Therefore, the control device 50 substitutes the detected temperature $T_b$ detected by the oil temperature detector 62 into a simple compensation formula fc and detects the oil temperature $T_o$ by the formula fc. The compensation formula fc can be derived from, e.g., an actual measurement performed with regards to a result of detection by the oil temperature detector 62 and a value detected through directly inserting a temperature sensor into the lubricating oil 70.

In step S13, the control device 50 compares the oil temperature target value $T_{so}$ and the oil temperature $T_o$ with each other. If the oil temperature $T_o$ has not reached the oil temperature target value $T_{so}$, the flow proceeds to step S14, the crank case heater 46 is put in an ON state, and the flow returns to step S10. If, upon the oil temperature target value $T_{so}$ and the oil temperature $T_o$ being compared with each other in step S13, the oil temperature $T_o$ has reached the oil temperature target value $T_{so}$, the control device 50 proceeds to step S15, the crank case heater 46 is put in an OFF state, and the flow returns to step S10.

Through performing control of such description, the control device 50 is able to control the crank case heater 46 so that the oil temperature $T_o$ satisfies the oil temperature target value $T_{so}$ during the compressor 40 is stopped.

(3) Oil Temperature Offset Value

As described above, the refrigeration device as an example of the air-conditioning device 10 is configured so that the control device 50 performs a control enabling the state in which the oil temperature $T_o$ of the lubricating oil 70 reaches the oil temperature target value $T_{so}$ to be maintained while the compressor 40 is stopped. The oil temperature target value $T_{so}$ is established from the saturation temperature $T_r$+the oil temperature offset value.

The oil temperature offset value is set such that the oil temperature target value $T_{so}$ is set to the temperature of a mixture of the lubricating oil 70 and the refrigerant at which the oil concentration at solubility equilibrium at refrigerant pressure LP assumes a predetermined set value.

Figure 5:
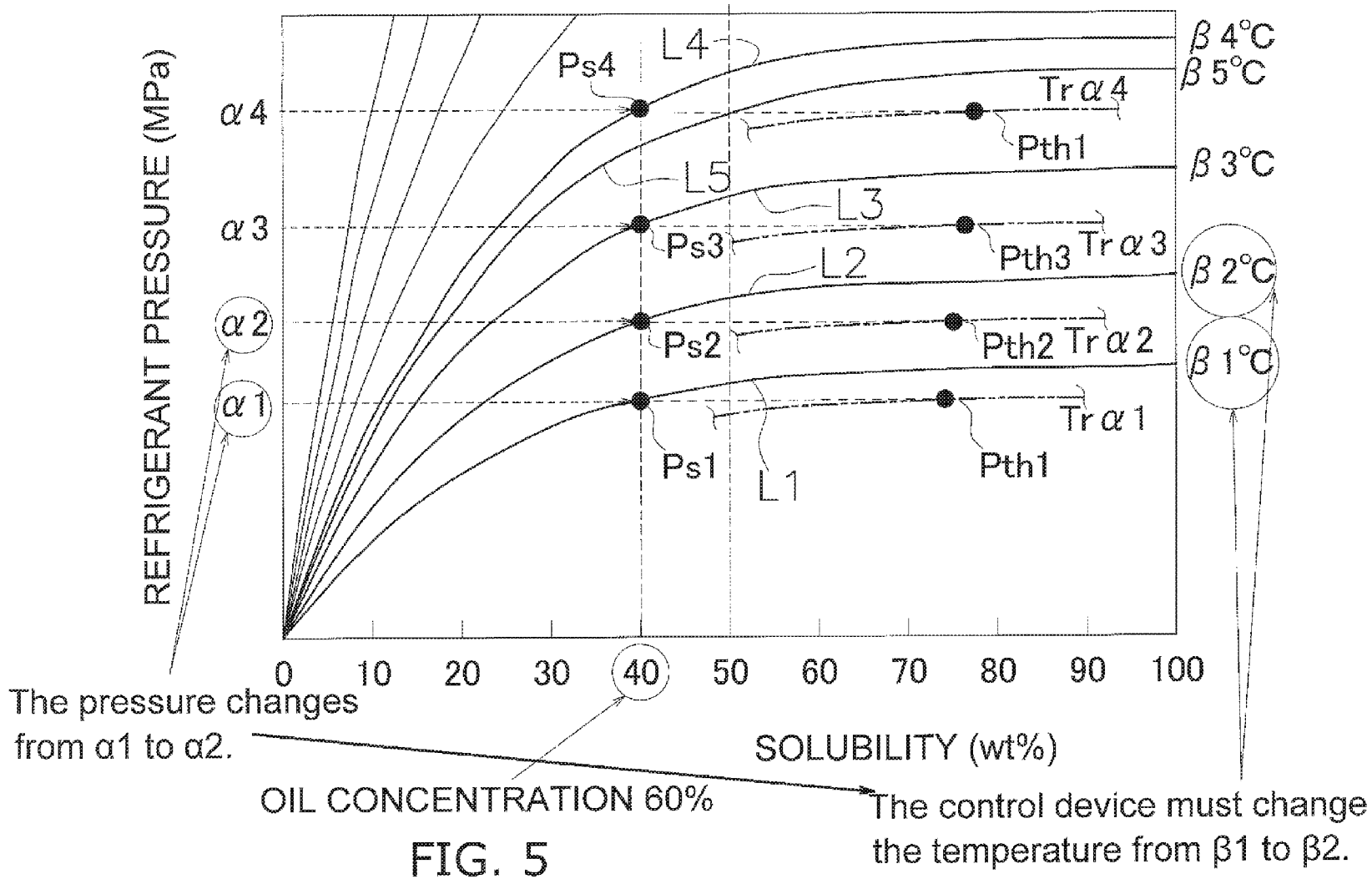
FIG. 5 is a graph showing the relationship between the refrigerant pressure, the degree of solubility, and the temperature of the mixture.

This matter will now be described using FIG. 5. FIG. 5 is a graph showing the relationship between the refrigerant pressure LP in an equilibrium state, the temperature of the mixture of the lubricating oil 70 and the refrigerant (hereafter referred to as the liquid temperature) and the refrigerant solubility. Points Ps1, Ps2, Ps3, and Ps4 shown in FIG. 5 corresponds to points P1, P2, P3, and P4 in FIG. 4, respectively.

Figure 6:
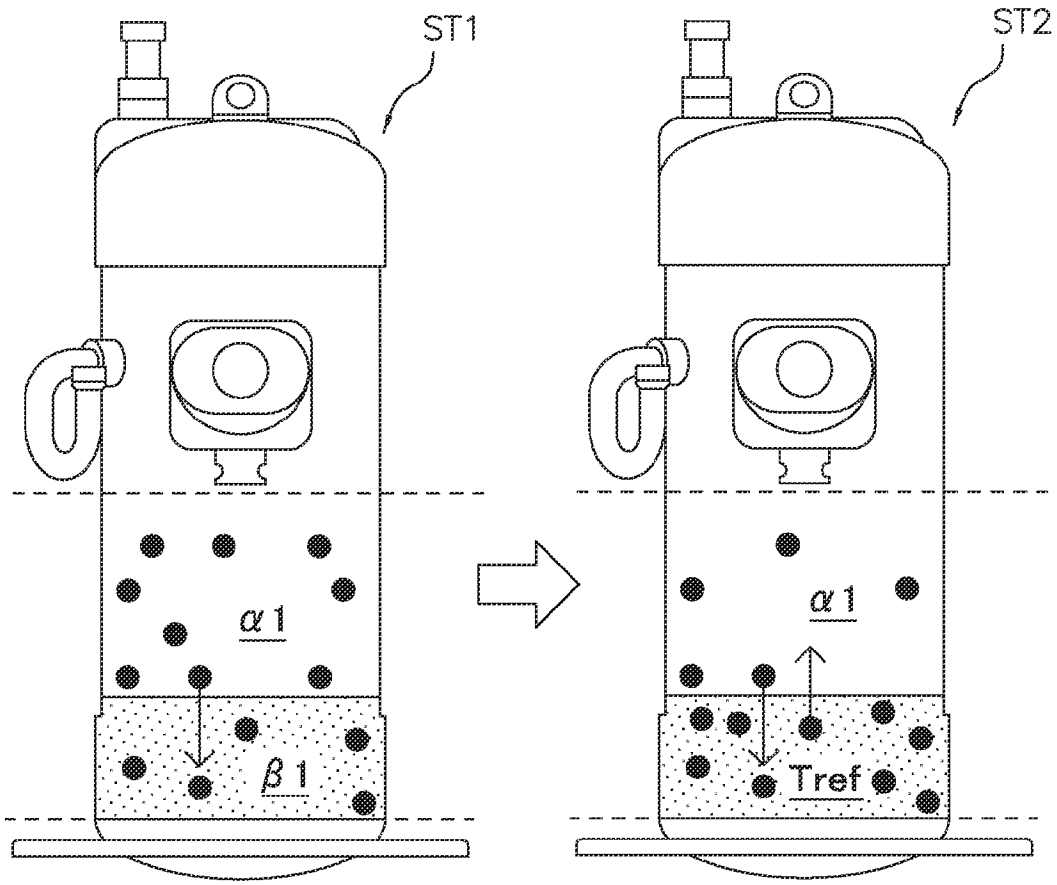
FIG. 6 is a schematic diagram illustrating the setting of the oil temperature offset value.

In the graph shown in FIG. 5, point Ps1 is a point at which, in a state in which the pressure is $\alpha 1$ and the liquid temperature is $\beta 1$ at solubility equilibrium, the oil concentration is 60% (i.e., the refrigerant solubility is 40%). As shown in FIG. 6, when the crank case heater 46 is left without being put in an ON state in the state ST1 at point Ps1, the liquid temperature changes from the current liquid temperature $\beta 1$ to a refrigerant saturation temperature $T_{r\alpha 1}$ at which the equilibrium state ST2 is maintained at pressure $\alpha 1$. At this time, the refrigerant further solves into the lubricating oil, and the oil concentration decreases from 60%. In other words, in order to maintain the oil concentration at 60%, the liquid temperature is held at $\beta 1$.

Therefore, the oil temperature offset value is derived from (liquid temperature at which the oil concentration is 60% at pressure $\alpha 1$ at solubility equilibrium)−(refrigerant saturation temperature at pressure $\alpha 1$), i.e., $\beta 1 - T_{r\alpha 1}$.

A description will now be given for the method for determining the oil temperature offset value for each refrigerant saturation temperature using FIGS. 4 and 5. With regards to the oil concentration, a desired set value for the oil concentration is determined for each refrigeration device from the viewpoint of reliability and cutting standby power. Therefore, for a refrigeration device in which, e.g., the oil concentration is set to 60%, the relationship between a straight line parallel to the vertical axis at which the solubility is 40% (hereafter referred to as the 40% line) and each of curves L1, L2, L3, L4, etc. is examined. It follows that the solubility curve with which the 40% line intersects at point Ps2 corresponding to pressure $\alpha 2$ is L2, the solubility curve with which the 40% line intersects at point Ps3 corresponding to pressure $\alpha 3$ is L3, and the solubility curve with which the 40% line intersects at point Ps4 corresponding to pressure $\alpha 4$ is L4. Meanwhile, the temperature of an imaginary solubility curve indicated by a two-dot chain line passing through point $P_{th2}$ at which the oil temperature and the saturation temperature are equal at pressure $\alpha 2$ is $T_{r\alpha 2}$. Similarly, the temperature of an imaginary solubility curve passing through point $P_{th3}$ corresponding to pressure $\alpha 3$ is $T_{r\alpha 3}$ and the temperature of an imaginary solubility curve passing through point $P_{th4}$ corresponding to pressure $\alpha 4$ is $T_{r\alpha4}$. Therefore, the oil temperature offset value for pressure α2 is a value obtained by subtracting temperature $T_{r\alpha2}$ from temperature β2 indicated by curve L2. Similarly, the oil temperature offset value is, tier pressure α3, a value obtained by subtracting temperature $T_{r\alpha3}$ from temperature β3 indicated by curve L3, and for pressure α4, a value obtained by subtracting temperature $T_{r\alpha4}$ from temperature β4 indicated by curve L4.

As described above, the oil temperature offset value is one that is determined as a single value once the pressure of the refrigerant in the compressor 40 is determined. In addition, the oil temperature offset value can be obtained in advance once the graph shown in FIG. 5 is established.

Points P1, P2, P3, and P4 in the graph shown in FIG. 4 are obtained by plotting the oil temperature offset values for four saturation temperatures obtained from the graph in FIG. 5. For example, the method of least squares or a similar method is applied with regards to each of the obtained points P1, P2, P3, and P4, and the gaps between the points are filled to complete the graph showing the relationship between the saturation temperature and the oil temperature offset value. Approximation formulae representing the curves in the graph shown in FIG. 4 are stored, as data, in the memory 50*b* of the control device 50.

(4) Characteristics (4-1)

As described above, the refrigeration device as an example of the air-conditioning device 10 is configured so as to comprise the indoor heat exchanger 21 (radiator or evaporator), the outdoor heat exchanger 31 (evaporator or radiator), the compressor 40, the crank case heater 46, the control device 50, the refrigerant pressure detector 61, and the oil temperature detector 62. The control device 50 controls the heater so that the oil temperature $T_o$ of the lubricating oil in the compressor 40 reaches the oil temperature target value $T_{so}$ obtained by adding the oil temperature offset value (predetermined temperature) to the saturation temperature $T_r$ of the refrigerant in the compressor 40.

Figure 7:
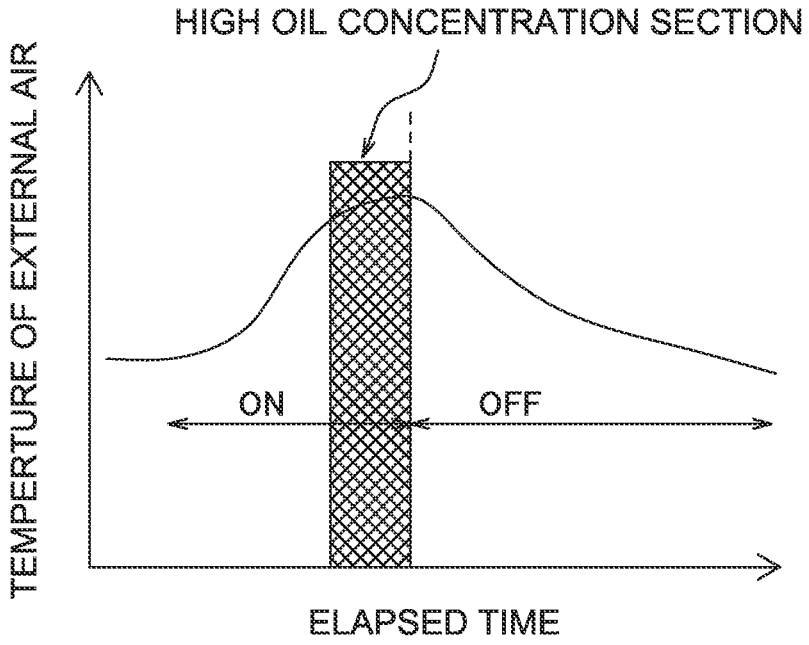
FIG. 7 is a graph illustrating the effect of the refrigeration device according to a first embodiment.

For example, in the techniques shown in Patent Literature 1 and 2, the crank case heater may be in an ON state even in a high-oil-concentration section as shown in FIG. 7. Specifically, when the external air temperature is increasing from a low state in which it is necessary for the crank case heater to be in an ON state, even if the oil concentration has become sufficiently high for there to be no need for the crank case heater to be in an ON state, the prevailing circumstances are maintained until the external air temperature is such that the crank case heater is to be turned off; therefore, the ON state may be maintained irrespective of the oil concentration However, in the control device 50 according to the abovementioned first embodiment, the oil temperature target value $T_{so}$ is set, according to the oil temperature offset value (predetermined temperature), to a temperature of the mixture of the lubricating oil 70 and the refrigerant (e.g., β1 to β4, etc.) at which the oil concentration at solubility equilibrium at pressure of the refrigerant in the compressor 40 is at a predetermined set value (e.g., 60%). Therefore, the control device 50 can control the crank case heater 46 according to the oil concentration without the heater control being affected by the external air temperature, and it is possible to cut the standby power without the crank case heater 46 being in an ON state in the high-oil-concentration section. The control device 50 can control the crank case heater 46 so as to obtain an oil temperature at which a fixed oil concentration is maintained.

Figure 8:
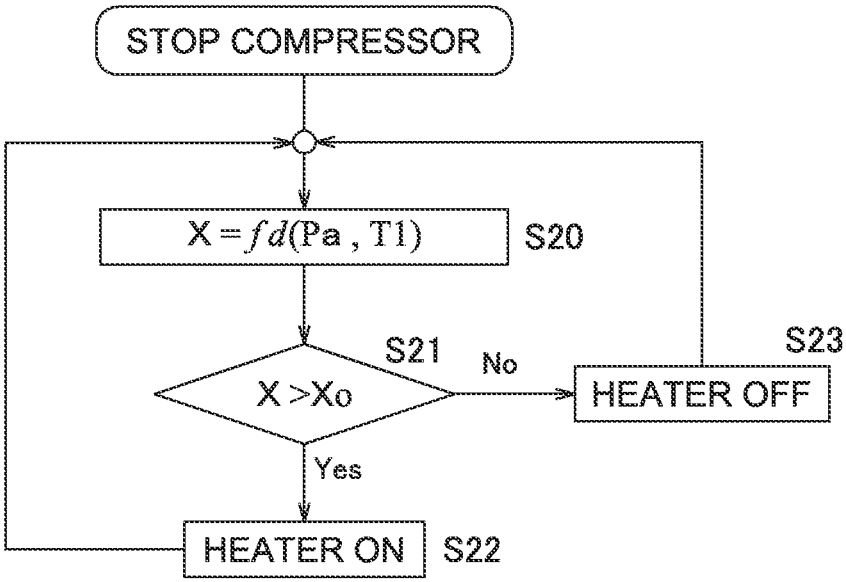
(BACKGROUND ART) FIG. 8
FIG. 8 is a flow chart illustrating heater control by a conventional control device.
Figure 9:
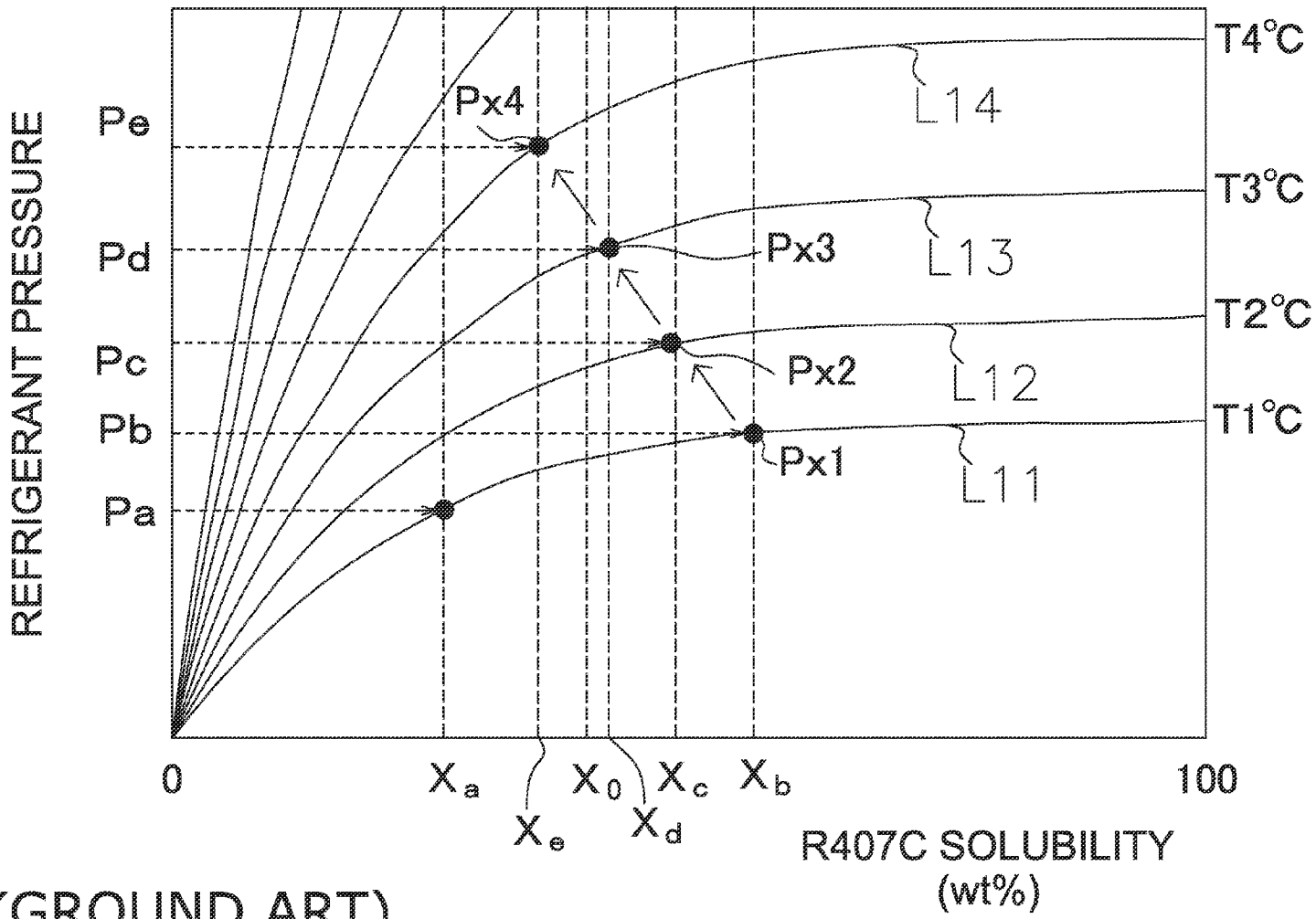
(BACKGROUND ART) FIG. 9
FIG. 9 is a schematic diagram illustrating heater control by a conventional control device.

Patent Literature 3 also discloses a technique for similarly controlling the crank case heater so as to maintain the oil concentration. However, in the technique in Patent Literature 3, the solubility of the oil in the compressor is calculated from solubility characteristics to obtain the target oil concentration, requiring a complex calculation, increasing the cost of the refrigeration device, and slowing the speed of response. FIG. 8 is a flow chart showing the conventional heater control according to the oil concentration disclosed in Patent Literature 3. FIG. 9 is a graph schematically showing solubility characteristics in order to illustrate the conventional heater control. In the conventional heater control, a solubility calculator calculates the solubility X from pressure Pa in the compressor detected by a shell interior pressure detector and temperature T1 detected by the oil temperature detector (step S20). Then, it is determined whether or not the calculated solubility X is higher than a set solubility X0 (step S21). If the calculated solubility is lower than the set solubility X0, as with the case of Xa, the heater is put in an OFF state (step S23), and if the calculated solubility is higher than the set solubility X0, as with the case of Xb, the heater is put in an ON state (see FIG. 9).

As described above, the conventional heater control in Patent Literature 3 looks superficially simple, but is not simple in reality. FIG. 9 is depicted so as to be partially deformed in order to facilitate comprehension. In the heater control in Patent Literature 3, it is necessary to search for the heater-OFF point Px4 while modifying the solubility curve such as from curve L11 to curves L12, L13, and L14. For example, while the pressure and liquid temperature at the calculated solubility Xb are Pb and T1, when the compressor is then warmed using the crank case heater, the pressure and the temperature subsequently measured would have changed to e.g., pressure Pc and temperature T2. It follows that curve L11 cannot be used as the solubility curve, and it is necessary to modify the solubility curve to curve L12. Moreover, since it is necessary to search for point Px2 on curve L12, it is necessary to return to step S20, re-perform the complex calculation using the solubility calculator, and calculate a solubility Xc. Thus, as the lubricating oil is heated using the crank case heater, the temperature changes from T1 to T2, T3, and T4, and the pressure also changes with every measurement such as from Pb to Pc, Pd, and Pe due to the effect of environmental temperature or the like, making it necessary to modify the solubility curve from L11 to L12, L13, and L14. Since solubility Xa, Xb, Xc, Xd, Xe, etc. cannot be obtained without performing a complex calculation using the two parameters of refrigerant pressure and oil temperature, the calculation takes time and the response is slower. In addition, there are diverse combinations of the refrigerant and the lubricating oil, the solubility curve must be prepared for each of the temperatures, and designing requires a large amount of workload.

In contrast, as shown in FIG. 4, in the refrigeration device according to the first embodiment above, even if there is a change in the temperature of the lubricating oil 70 and the refrigerant pressure due to the crank case heater 46 being switched ON or OFF, the oil temperature offset value can be obtained, using a single, simple formula representing the curves in FIG. 4, from the saturation temperature $T_r$ obtained from the temperature of the lubricating oil 70 and the refrigerant pressure. In other words, the control device 50 according to the above first embodiment is not required to hold the solubility curve information, and the calculation involved in heater control can be simplified. In addition, even if the types of lubricating oil and refrigerant change, and it becomes necessary to newly acquire data such as that shown in FIG. 4 to be held by the control device 50, it is only necessary for the oil temperature offset value and the saturation temperature in relation to a predetermined set value for the oil concentration (e.g., 60%) to be established. Therefore, there is no need to hold a solubility curve as data, and the design workload is reduced. While in the above first embodiment, a description was given for an instance in which ON/OFF control is performed, since, in the air-conditioning device 10 according to the present embodiment, temperature is the only parameter according to which the control device 50 controls the crank case heater 46, it is also easy to arrive at a configuration in which proportionality control or the like is used to reduce the time taken to reach the oil temperature target value $T_{so}$.

(4-2)

In addition, the amount of data stored by the memory 50*b* of the control device 50 is smaller. As long as an oil temperature offset value (predetermined temperature) is held as data for each saturation temperature shown in FIG. 4, the memory capacity and/or calculation load required for, e.g., the calculation by the control device 50 can be omitted. It is thereby possible for the control device 50 to control the crank case heater 46 at a high speed, and the speed of response of the compressor 40 to a change in situation is increased.

(5) Modification Examples (5-1)

The relationship between the oil temperature offset value and the saturation temperature held by the control device 50 may be represented by a curve or a straight line corresponding to an oil concentration in a predetermined set range, e.g., 60 to 65%, instead of a curve corresponding to an oil concentration of 60%. For example, line LN in FIG. 4 falls within a set oil concentration range of 60 to 65%. On the side at which the saturation temperature is relatively low, the straight line LN is nearer a curve showing the relationship between the oil temperature offset value and the saturation temperature for which the set oil concentration value is 65%, and on the side at which the saturation temperature is relatively high, the straight line LN is nearer a curve showing the relationship between the oil temperature offset value and the saturation temperature for which the set oil concentration value is 60%.

The control device 50 performing a control using a straight line LN of such description will result in the oil concentration being controlled to a range that has a moderate width (e.g., 60 to 65%). However, a control performed within such a range is sufficient. It is also possible to adopt a setting so that the set oil concentration value changes within a predetermined setting range due to another reason. When the straight line LN is used, the oil temperature offset value is obtained by proportional calculation from the saturation temperature, simplifying the control.

(5-2)

In the first embodiment above, as shown in FIG. 4, using the oil concentration as the set value, the relationship between the oil temperature offset value and the saturation temperature at which the oil concentration is within a predetermined set range or at a predetermined set value is obtained, and the control device 50 controls the crank case heater 46 using the obtained relationship.

However, an oil viscosity value may be used instead of an oil concentration value with regards to the predetermined set range or the predetermined set value used when obtaining the relationship between the saturation temperature and the oil temperature offset value. An original purpose of controlling the crank case heater 46 so that the oil concentration is within a predetermined set range or at a predetermined set value is to prevent a decrease in oil viscosity. Therefore, heater control may be performed so as to directly achieve this purpose. The oil temperature offset value can be established, in an instance in which oil viscosity is used, in a similar manner to that in the instance in which oil concentration is used.

(5-3)

In the first embodiment above, a description was given for an instance in which the oil temperature detector 62 detects the oil temperature of the lubricating oil 70 in the compressor 40. However, the oil temperature of the lubricating oil 70 may be estimated from a result of detection by another measurement device. For example, the oil temperature may be estimated through further increasing the accuracy by correcting the result of detection by the oil temperature detector 62 with, e.g., the temperature of external air surrounding the compressor 40 and/or the temperature of the indoor heat exchanger 21. Alternatively, the oil temperature of the lubricating oil 70 in the compressor 40 may be estimated from a result of measurement by another measurement instrument for performing a measurement in relation to a parameter for estimating the oil temperature of the lubricating oil 70, without using the oil temperature detector 62.

(5-4)

In the first embodiment above, the control device 50 performs ON/OFF control of the crank case heater 46. However, the control device 50 may perform a control so as to change the amount of heating according to the oil temperature offset value. For example, there may be an instance in which the oil temperature offset value becomes negative when there is a sharp change in the pressure in the compressor 40. In such an instance, a modification may be performed that the amount of heating is greater than in an instance in which the oil temperature offset value is positive.

(5-5)

In the first embodiment above, the refrigerant pressure detector 61 is mounted on the intake pipe 43, and the pressure of the refrigerant in the compressor 40 is measured on the side of the intake pipe 43. However, in an instance in which the pressure of the refrigerant in the compressor 40 can be measured more satisfactorily on the side of the discharge pipe 42 than on the side of the intake pipe 43, the pressure may be detected upon mounting, the refrigerant pressure detector 61 on the discharge pipe 42.

(5-6)

In the first embodiment above, the saturation gas temperature is used as the saturation temperature. However, the saturation liquid temperature may be used as the saturation temperature.

(5-7)

In the first embodiment above, the lubricating oil 70 is warmed using the crank case heater 46. However, the heater for warming the lubricating oil 70 is not limited to the crank case heater 46. For example, motor coil heating using open-phase energization may be used as a method for warming the lubricating oil 70; in such an instance, a motor cod is used as the heater for warming the lubricating oil 70. In such an instance, the control device 50 performs, as heater control, ON/OFF control of motor coil heating using open-phase energization.

Second Embodiment (6) Overview of Refrigeration Device

In the first embodiment above, a description was given with regards to controlling the heater while the refrigeration device of the air-conditioning device 10 is being supplied with power and the refrigeration device of the air-conditioning device 10 is maintaining an power-on state. However, situations in which the refrigeration device of the air-conditioning device 10 may be placed include a state in which the power supply of the air-conditioning device 10 is cut. In a compressor 40 that is stopped for a long period of time in a state in which the power supply is cut, the refrigeration oil in the compressor 40 cannot be heated, and a large amount of the refrigerant may solve into the refrigeration oil due to a change in the external air temperature. An air-conditioning device 10 according to a second embodiment described below is configured so as to make it possible to perform a control to prevent defects caused by a decrease in viscosity due to a large amount of refrigerant dissolving into the refrigeration oil when the power supply is switched back on after the power supply has been cut.

A refrigeration device according to the second embodiment may be configured in a similar manner to the refrigeration device of the air-conditioning device 10 according to the first embodiment. Therefore, the following description of the refrigeration device according to the second embodiment will focus on the control performed when the power supply is switched back on after the power supply has been cut, with the configuration of the refrigeration device according to the second embodiment being the same as that of the refrigeration device of the air-conditioning device 10 according to the first embodiment.

(7) Heater Control

Figure 10:
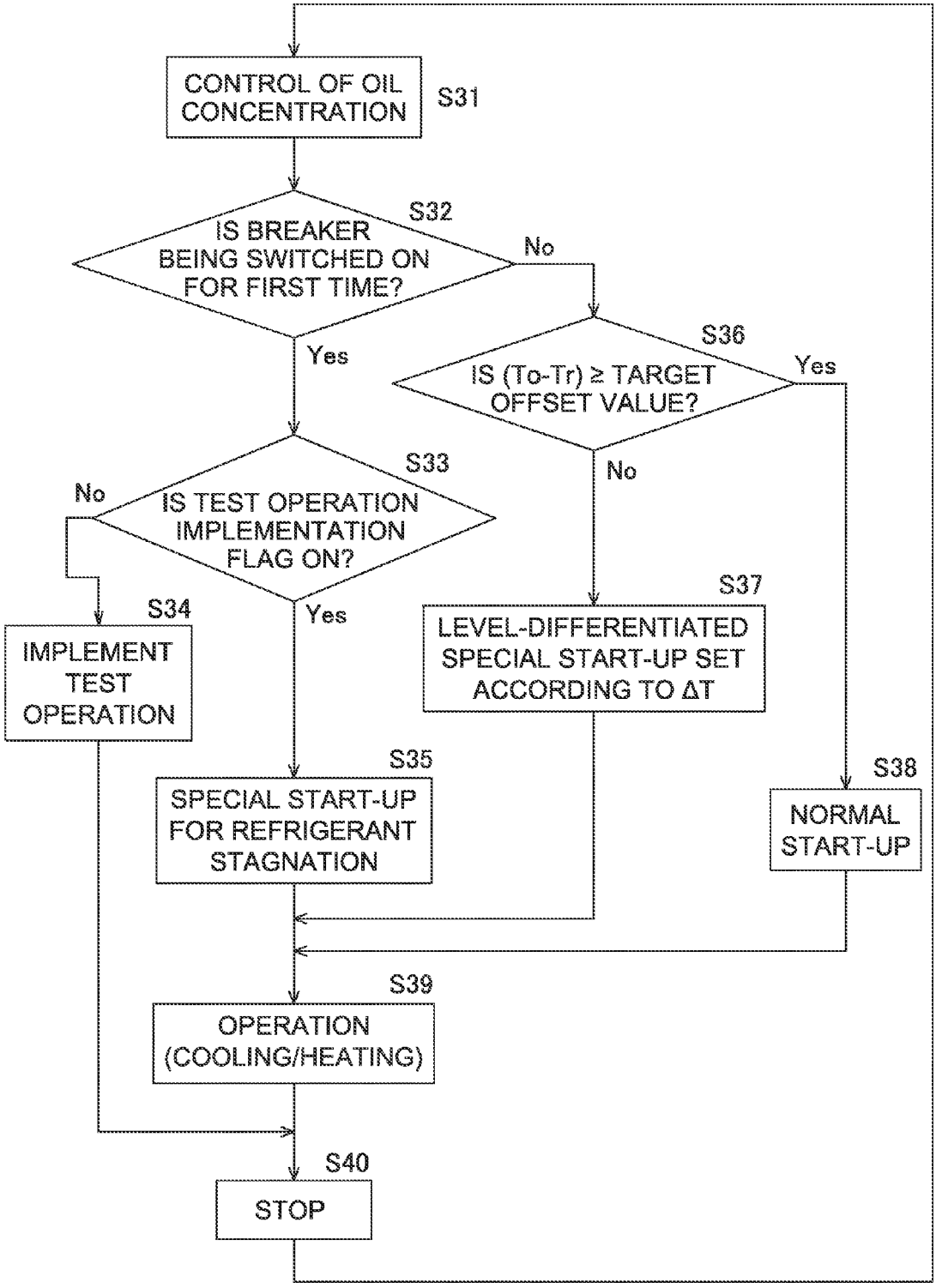
FIG. 10 is a flow chart illustrating heater control by a control device according to a second embodiment.

FIG. 10 is a flow-chart showing the actuation of heater control during start-up of the refrigeration device according to the second embodiment. The control of constant oil concentration in step S31 is the control described in the first embodiment, and indicates heater control other than that corresponding to start-up. In other words, steps S32 to S37 are subroutines of the heater control according to the first embodiment. Therefore, steps S32 to S37 may be performed at an appropriate point in time in the heater control according to the first embodiment.

At start-up, it is determined whether or not the breaker is being switched ON for the first time (step S32). This corresponds to determining whether or not the start-up is one in which a test operation is performed. If the breaker being switched ON is for the first time, a test operation is generally thought to be necessary. Therefore, if the breaker is being switched on for the first time, the flow proceeds to step S33. In step S33, it is determined whether or not a test operation implementation flag is ON. If the test operation is implemented, the test operation implementation flag is switched ON. This test operation implementation flag is stored, e.g., in the memory 50*b* of the control device 50. If the test operation implementation flag is OFF, the test operation has not yet been implemented, so the test operation is implemented (step S34). If the test operation implementation flag is not OFF, the test operation has already been implemented, so special start-up for the refrigerant stagnation is performed (step S35). Special start-up is one that is performed upon modifying the setting from that corresponding to normal start-up to a setting that is more suited to a state in which a large amount of the refrigerant has solved into the lubricating oil in the compressor (refrigerant stagnation state). Instances in which it is determined that the breaker is being switched ON for the first time may include, e.g., an instance in which no power has been supplied to the air-conditioning device 10 at all due to a power cut or the like. Following the test operation in step S34 and the special start-up in step S35, an operation such as a cooling operation or a heating operation is performed (step S39). Then, the control device 50 stops the operation of the air-conditioning device 10 when, e.g., the control device 50 receives an instruction to stop the operation (step S40). Heater control other than that corresponding to start-up is performed after the operation has stopped (step S31).

On the other hand, if, at start-up, it is determined that the breaker is not being switched ON for the first time (step S32), it is determined whether or not (To−Tr) is equal to or less than a target offset value. The target offset value is a value obtained by subtracting the saturation temperature $T_r$ from the oil temperature target value $T_{so}$ at which the target oil concentration is achieved, and is one that is continually calculated and renewed according to the change in situation (at predetermined time intervals). If (To−Tr) is greater than the target offset value, the target oil concentration is realized, so normal start-up is performed (step S38).

If it is determined in step S36 that (To−Tr) is equal to or smaller than the target offset value, the control device 50 performs level-differentiated special start-up set according to the value of ΔT (step S37). Here, ΔT corresponds to {target offset value−(To−Tr)}. For example, if ΔT is such that $0 \leq \Delta T \leq 5°$ C., low-level special start-up is performed, and if $\Delta T > 5°$ C., high-level special start-up is performed. More so than that for the low-level special start-up, the setting for the high-level special start-up is more suitable for start-up in an instance in which more than a predetermined amount of the refrigerant has solved into the lubricating oil in the compressor.

A description of the determining performed in step S36 using a specific example is as follows. First, the pressure of the refrigerant and the oil temperature are read from the intersection on the graph at the target oil concentration, and the oil temperature offset value is obtained. For example, intersections Ps1, Ps2, Ps3, and Ps4 between the line corresponding to an oil concentration of 60% (solubility of 40 wt %) and equal-oil-temperature lines in FIG. 5 are read. The pressure at the intersections are converted to saturation temperatures $T_r$ and subtracted from the oil temperature $T_o$ to obtain (To−Tr).

Thus, since values are directly read from a graph obtained through actual experiments or the like (i.e., since the values are directly derived from the actual relationship between the refrigerant pressure, the oil temperature, and the target oil concentration), the relationship between all parameters used in heater control performed by the control device 50 is reproduced to a high degree of accuracy.

In addition, if the in-dome oil amount (100%) held by the compressor 40 is clearly known, the oil surface height can be calculated in reverse from the target oil concentration. Therefore, in an instance in which there is a likelihood of a terminal insulation fault caused the terminal being immersed in the lubricating oil during start-up, it is also possible to modify the target oil concentration and cause the control device 50 to perform a control so as to avoid the insulation fault.

(7) Characteristics (7-1)

As described above, the control device 50 of the air-conditioning device 10 according to the second embodiment performs, at start-up, a selection between normal start-up and special start-up on the basis of (To−Tr) and the target offset value (example of the oil temperature of the lubricating oil and the oil temperature target value) (step S36). Since a selection can be made between normal start-up and special start-up, when special start-up is necessary, it is possible to proceed to step S37 and perform special start-up, improving reliability.

(7-2)

If the special start-up is selected instead of normal start-up, the control device 50 selects the high-level special start-up or the low-level special start-up (examples of a plurality of special start-ups) on the basis of ΔT (example of the oil temperature of the lubricating oil and the oil temperature target value) (step S37). Since an appropriate special start-up can be thus selected, it is possible to select a more appropriate special start-up and start-up the compressor 40 compared to an instance in which no selection of special start-up is possible, further improving the reliability.

(7-3)

At the initial start-up after the power supply fed to the air-conditioning device 10 from the exterior is switched ON, the control device 50 selects, according to test operation implementation history, whether to perform a test operation or to perform a special start-up (step S33). Since the control device 50 can be used to switch between test operation and stagnation operation, it is possible to perform a test operation of the refrigeration device as required at the site of use and the like. It is thereby possible, through performing a test operation, to avoid having to perform an unnecessary special start-up, facilitating the refrigeration device installation.

(8) Modification Examples (8-1)

In the second embodiment above, even when it is determined in step S33 that the test operation has been completed, the state after the stoppage is not known; therefore, special start-up is performed instead of normal start-up. However, it is possible to further apply, with regards to the special start-up, the high-level special start-up set in step S37.

In addition, when the condition for entering step S35 is satisfied, a measure for increasing the target oil concentration can also be taken.

What is claimed is:

1. A refrigeration device, comprising:

a radiator configured to cause a refrigerant to radiate heat;

an evaporator configured to cause the refrigerant to evaporate;

a compressor configured and arranged to compress the refrigerant circulating between the radiator and the evaporator;

a refrigerant pressure detector configured to detect a pressure of the refrigerant in the compressor;

a heater configured to heat lubricating oil in the compressor; and a control device configured to calculate saturation temperature of the refrigerant in the compressor in a state in which the compressor is stopped and control the heater so that an oil temperature of the lubricating oil in the compressor reaches an oil temperature target value obtained by adding an oil temperature offset value to the saturation temperature of the refrigerant in the compressor in a state in which the compressor is stopped, the oil temperature offset value being determined as a single value once the pressure of the refrigerant in the compressor is determined, and the oil temperature target value being set, using the oil temperature offset value, such that a temperature of a mixture of the lubricating oil and the refrigerant is held to maintain oil concentration or oil viscosity at solubility equilibrium at the pressure of the refrigerant within a predetermined set range.

2. The refrigeration device according to claim 1, wherein the oil temperature target value is set, using the oil temperature offset value, such that the temperature of the mixture of the lubricating oil and the refrigerant is held to maintain the oil concentration or the oil viscosity at solubility equilibrium at the pressure of the refrigerant at a predetermined set value.

3. The refrigeration device according to claim 1, wherein the control device is further configured to store the oil temperature offset value as data for each of a plurality of saturation temperatures.

4. The refrigeration device according to claim 1, further comprising a temperature detector configured to measure the oil temperature of the lubricating oil in the compressor and to output the oil temperature to the control device or a measurement device configured to perform a measurement relating to a parameter used to estimate the oil temperature of the lubricating oil in the compressor and to output a result of the measurement to the control device.

5. The refrigeration device according to claim 4, wherein the control device is further configured to perform, when the refrigeration device is being started up, a selection between normal start-up and special refrigerant stagnation start-up based on the oil temperature of the lubricating oil and the oil temperature target value, the special refrigerant stagnation start-up being different from the normal start-up.

6. The refrigeration device according to claim 5, wherein the special refrigerant stagnation start-up includes a plurality of special start-ups having different settings from each other, and when the special refrigerant stagnation start-up is selected instead of the normal start-up, the control device if configured to perform a selection of one of the plurality of special start-ups based on the oil temperature of the lubricating oil and the oil temperature target value.

7. The refrigeration device according to claim 5, wherein at an initial start-up after a power supply fed to the refrigeration device from an exterior is switched ON, the control device is further configured select whether to perform a test operation or to perform the special refrigerant stagnation start-up according to test operation implementation history.

8. The refrigeration device according to claim 2, wherein the control device is further configured to store the oil temperature offset value as data for each of a plurality of saturation temperatures.

9. The refrigeration device according to claim 2, further comprising a temperature detector configured to measure the oil temperature of the lubricating oil in the compressor and to output the oil temperature to the control device or a measurement device configured to perform a measurement relating to a parameter used to estimate the oil temperature of the lubricating oil in the compressor and to output a result of the measurement to the control device.

10. The refrigeration device according to claim 3, further comprising a temperature detector configured to measure the oil temperature of the lubricating oil in the compressor and to output the oil temperature to the control device or a measurement device configured to perform a measurement relating to a parameter used to estimate the oil temperature of the lubricating oil in the compressor and to output a result of the measurement to the control device.

11. The refrigeration device according to claim 6, wherein at an initial start-up after a power supply fed to the refrigeration device from an exterior is switched ON, the control device is further configured select whether to perform a test operation or to perform the special refrigerant stagnation start-up according to test operation implementation history.

12. A refrigeration device, comprising a radiator configured to cause a refrigerant to radiate heat;

an evaporator configured to cause the refrigerant to evaporate;

a compressor configured and arranged to compress the refrigerant circulating between the radiator and the evaporator;

a refrigerant pressure detector configured to detect a pressure of the refrigerant in the compressor;

a heater configured to heat lubricating oil in the compressor; and a control device configured to control the heater so that an oil temperature of the lubricating oil in the compressor reaches an oil temperature target value obtained by adding an oil temperature offset value to saturation temperature of the refrigerant in the compressor in a state in which the compressor is stopped, the oil temperature offset value being determined as a single value once the pressure of the refrigerant in the compressor is determined, the oil temperature target value being set, using the oil temperature offset value, such that a temperature of a mixture of the lubricating oil and the refrigerant is held to maintain oil concentration or oil viscosity at solubility equilibrium at the pressure of the refrigerant within a predetermined set range, and the control device is further configured to control the heater to repeat turning on and turning off in a state in which the compressor is stopped.

13. The refrigeration device according to claim 1, wherein the control device is further configured to perform proportionality control to the heater in a state in which the compressor is stopped.

* * * * *